US006705716B2

(12) United States Patent
Mott

(10) Patent No.: US 6,705,716 B2
(45) Date of Patent: Mar. 16, 2004

(54) THERMAL INK JET PRINTER FOR PRINTING AN IMAGE ON A RECEIVER AND METHOD OF ASSEMBLING THE PRINTER

(75) Inventor: James A Mott, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 43 days.

(21) Appl. No.: 09/975,802

(22) Filed: Oct. 11, 2001

(65) Prior Publication Data

US 2003/0071882 A1 Apr. 17, 2003

(51) Int. Cl.[7] ..... B41J 2/17; B41J 2/14
(52) U.S. Cl. ..... 347/94; 347/48
(58) Field of Search ..... 347/20, 44, 47, 347/48, 54, 56, 61, 62, 84, 94, 21

(56) References Cited

U.S. PATENT DOCUMENTS

| | | | | | |
|---|---|---|---|---|---|
| 3,946,398 | A | | 3/1976 | Kyser et al. | |
| 4,057,807 | A | | 11/1977 | Fischbeck et al. | |
| 4,210,920 | A | | 7/1980 | Burnett et al. | |
| 4,480,259 | A | | 10/1984 | Kruger et al. | |
| 4,520,375 | A | | 5/1985 | Kroll | |
| 4,528,574 | A | | 7/1985 | Boyden | |
| 4,528,579 | A | * | 7/1985 | Bresica | 347/94 |
| 5,699,093 | A | * | 12/1997 | Alderson | 347/94 |
| 5,943,079 | A | * | 8/1999 | Yoshida | 347/94 |
| 5,993,079 | A | | 11/1999 | O'Brien et al. | |
| 6,186,610 | B1 | | 2/2001 | Kocher et al. | |
| 6,193,346 | B1 | | 2/2001 | Nakano | |
| 6,241,342 | B1 | | 6/2001 | Silverbrook | |
| 6,247,790 | B1 | | 6/2001 | Silverbrook et al. | |
| 6,248,249 | B1 | | 6/2001 | Silverbrook | |
| 6,290,335 | B1 | * | 9/2001 | Kawai et al. | 347/62 |

* cited by examiner

*Primary Examiner*—Stephen D. Meier
*Assistant Examiner*—An H. Do
(74) *Attorney, Agent, or Firm*—Walter S. Stevens

(57) ABSTRACT

A thermal ink jet printer for printing an image on a receiver and method of assembling the printer. The printer comprises a print head defining a first chamber and a second chamber therein. The first chamber contains a working fluid and the second chamber contains an ink body. A flexible membrane separates the first chamber and the second chamber. A first transducer in the first chamber induces a first pressure wave in the working fluid that flexes the membrane into the second chamber to pressurize the ink body and eject an ink drop from the second chamber through an outlet. A second transducer in the first chamber induces a second pressure wave that flexes the membrane into the second chamber to damp the first pressure wave transmitted into the second chamber.

16 Claims, 14 Drawing Sheets

THERMAL INK JET PRINTER FOR PRINTING AN IMAGE ON A RECEIVER AND METHOD OF ASSEMBLING THE PRINTER

BACKGROUND OF THE INVENTION

This invention generally relates to printer apparatus and methods and more particularly relates to a thermal ink jet printer for printing an image on a receiver and method of assembling the printer, the printer being adapted for high speed printing and increased thermal resistor lifetime.

An ink jet printer produces images on a receiver medium by ejecting ink droplets onto the receiver medium in an image-wise fashion. The advantages of non-impact, low-noise, low energy use, and low cost operation in addition to the ability of the printer to print on plain paper are largely responsible for the wide acceptance of ink jet printers in the marketplace.

In the case of ink jet printers, at every orifice a pressurization actuator is used to produce the ink droplet. In this regard, either one of two types of actuators may be used. These two types of actuators are heat actuators and piezoelectric actuators. With respect to piezoelectric actuators, a piezoelectric material is used. The piezoelectric material possesses piezoelectric properties such that an electric field is produced when a mechanical stress is applied. The converse also holds true; that is, an applied electric field will produce a mechanical stress in the material. Some naturally occurring materials possessing this characteristic are quartz and tourmaline. The most commonly produced piezoelectric ceramics are lead zirconate titanate, lead metaniobate, lead titanate, and barium titanate. With respect to heat actuators, a heater placed at a convenient location heats the ink and a quantity of the ink phase changes into a gaseous steam bubble. The steam bubble raises the internal ink pressure sufficiently for an ink droplet to be expelled towards the recording medium.

In the case of heat-actuated and piezoelectric actuated ink jet printers, a pressure wave is established in the ink contained in the print head. That is, in the case of piezoelectric actuated print heads, the previously mentioned mechanical stress causes the piezoelectric material to bend, thereby generating the pressure wave. In the case of heat-actuated print heads, the previously mentioned vapor bubble generates the pressure wave. As intended, this pressure wave squeezes a portion of the ink in the form of the ink droplet out the print head. Of course, if the time between actuations of the print head is sufficiently long, the pressure wave dies-out before each successive actuation of the print head. It is desirable to allow each pressure wave to die-out between successive actuations of the print head. That is, actuation of the print head before the previous pressure wave dies-out interferes with precise ejection of ink droplets from the print head, which leads to ink droplet placement errors and drop size variations. Such ink droplet placement errors and drop size variations in turn produce image artifacts such as banding, reduced image sharpness, extraneous ink spots, ink coalescence and color bleeding.

Therefore, in the case of piezoelectric and thermal ink jet printers, printer speed is selected such that the print head is activated only at intervals after each successive pressure wave dies-out. Such delayed printer operation is required in order to avoid interference of a newly formed pressure wave with a preexisting pressure wave in the print head. Otherwise allowing the preexisting pressure wave to interfere with the newly formed pressure wave results in the aforementioned ink droplet placement errors and drop size variations. However, operating the printer in this manner reduces printing speed because ejection of an individual ink droplet must wait for the preexisting pressure wave, caused by ejection of a previous ink droplet, to naturally die-out. Therefore, a problem in the art, for both heat-actuated printers and piezoelectric printers, is decreased printer speed occasioned by the time required to allow a preexisting pressure wave in the print head to naturally die-out before introducing a new pressure wave to eject another ink droplet.

Moreover, in the case of heat-actuated ink jet printers, a heating element, commonly referred to in the art as a "resistor", is in direct contact with the ink in the print head to heat the ink. As previously mentioned, in the case of heat-actuated ink jet printers, a quantity of the ink phase changes into a gaseous steam bubble that raises the internal ink pressure sufficiently for an ink droplet to be expelled to the recording medium. However, it has been observed that over time the ink droplet will "decel" or decelerate and experience a transient decrease in velocity and/or droplet volume after a relatively small number of print head firing cycles. At resumption of firing after a pause, droplet velocity and/or droplet volume recovers, only to decel again in the same manner. Although this phenomenon is not fully understood, the result of "decel" is interference with proper image formation. It has also been observed, in the case of heat-actuated ink jet printers, that resistor performance is decreased by a phenomenon referred to in the art as "kogation". The terminology "kogation" refers to the permanent build-up of an ink component's burned residue on the resistor. This residue limits the resistor's energy transfer efficiency to the ink and causes the print head to permanently eject droplets with lower velocity or lower droplet volume. Therefore, quite apart from the problem of reduced printer speed, other problems in the art of ink jet printing are decel and kogation.

Also, in the case of heat-actuated ink jet printers, bubble collapse can lead to erosion and cavitation damage to the resistor. In other words, the repeated, relatively high speed collapse of the vapor bubble produces successive acoustic waves that impact the resistor. Over time, these successive impacts combined with the exposure of the resistor to chemical composition of the ink components corrode the resistor. Such cavitation leads to reduced operational lifetime for the resistor. Therefore, another problem in the art is cavitation damage to the resistor.

In addition, in the case of heat-actuated ink jet printers, inks must function within a thermal or vaporization constraint. That is, the ink must vaporize at a predetermined temperature in order to form the vapor bubble when required. But for the vaporization constraint required by heat-actuated ink jet printers, various ink components could be included in the ink formulation to enhance printing characteristics. In other words, less soluble components, such as pigments, polymers, or certain surfactants, could be included at higher concentrations in the ink. In general, less soluble components in the ink provide better ink durability on paper because once the ink is deposited on paper, the ink is not easily resolubilized. Also, increasing viscosity or surface tension may improve ink/media interactions that affect print quality (e.g., dot gain, bleed, "feathering", or the like), drytime and durability. Therefore, yet another problem in the art are limitations on types of ink useable in heat-actuated ink jet printers, which limitations are caused by constraints placed on vaporization limits of the ink.

Techniques to address the above recited problems are known. For example, an ink jet printer with a flexible membrane between ink and a working fluid is disclosed in U.S. Pat. No. 4,480,259 titled "Ink Jet Printer With Bubble Driven Flexible Membrane" issued Oct. 30, 1984, in the name of William P. Kruger, et al. and assigned to the assignee of the present invention. The Kruger, et al. patent discloses an ink-containing channel having an orifice for ejecting ink and an adjacent channel containing another liquid that is to be locally vaporized. Between the two channels is a flexible membrane for transmitting a pressure wave from a vapor bubble in the adjacent channel to the ink-containing channel, thereby causing ejection of a drop or droplets of ink from the orifice. According to the Kruger. et al. patent, a major advantage of the Kruger, et al. device is separation of the fluid to be vaporized from the ink. In this manner, according to the Kruger et al. patent, this separation permits use of conventional ink formulations, while at the same time making it possible to use special formulations of non-reactive and/or high molecular weight fluid in the bubble-forming chamber in order to prolong resistor lifetime. Moreover, as briefly indicated in the Kruger et al. patent, use of the membrane separating the ink and working fluid is intended to avoid erosion damage to the resistor. However, the Kruger, et al. patent does not address the problem of decreased printer speed occasioned by the time required to allow a preexisting pressure wave in the print head to naturally die-out before introducing a new pressure wave to eject an ink droplet.

A technique for damping a pressure wave to achieve increased printer speed and to prevent satellite ink droplet formation in a piezoelectric ink jet print head is disclosed in U.S. Pat. No. 6,186,610 titled "Imaging Apparatus Capable Of Suppressing Inadvertent Ejection Of A Satellite Ink Droplet Therefrom And Method Of Assembling Same" issued Feb. 13, 2001, in the name of Thomas E. Kocher, et al. An object of the Kocher, et al. patent is to provide an imaging apparatus capable of suppressing inadvertent ejection of a satellite ink droplet while maintaining printing speed. According to the Kocher, et al. patent, a print head defines a chamber having an ink body therein. A transducer (i.e., a piezoelectric transducer) is in fluid communication with the ink body for inducing a first pressure wave in the ink body. The first pressure wave squeezes an ink droplet from the ink body for ejection of the ink droplet from the print head. However, the first pressure wave is reflected from the walls of the ink chamber. Thus, the first pressure wave forms an undesirable reflected portion of the first pressure wave. This reflected portion of the first pressure wave may have amplitudes sufficient to inadvertently eject so-called "satellite" droplets following ejection of the intended ink droplet. Moreover, proper ejection of another ink droplet must await for the reflected portion to naturally die-out. Therefore, the Kocher, et al. device includes a thin piezoelectric sensor wafer spanning the ink channel for sensing the reflected portion of the first pressure wave. Once the sensor wafer senses the reflected portion, a second pressure wave is caused to be generated in the ink channel. According to the Kocher, et al. patent, the second pressure wave has an amplitude and a phase that damps the reflected portion, so that satellite droplets are not formed and so that printing speed is not reduced. However, the Kocher, et al. patent does not address pressure wave damping in a heat-actuated (i.e., non-piezoelectric) ink jet printer. In addition, the Kocher, et al. patent does not address separation of a working fluid from the ink to be ejected.

Therefore, what is needed is a thermal ink jet printer for printing an image on a receiver and method of assembling the printer, the printer being adapted for high speed printing and increased thermal resistor lifetime.

SUMMARY OF THE INVENTION

The present invention resides in a thermal ink jet printer for printing an image on a receiver, comprising a print head defining a first chamber therein for receiving a working fluid and defining a second chamber therein; a flexible membrane separating the first chamber and the second chamber; a first transducer in communication with working fluid in the chamber for inducing a first pressure wave in the working fluid in the first chamber, so that said membrane flexes into the second chamber; and a second transducer in communication with the working fluid in the first chamber for inducing a second pressure wave in the working fluid in the first chamber, so that said membrane flexes into the second chamber.

According to an aspect of the present invention, the printer comprises a print head defining a first chamber and a second chamber therein. The first chamber contains a working fluid, such as water. The second chamber contains an ink body in communication with an ink ejection nozzle formed in the print head. A flexible membrane separates the first chamber and the second chamber. A first transducer is disposed in the first chamber and is in communication with the working fluid for inducing a first pressure wave that flexes the membrane into the second chamber. When the first membrane flexes into the second chamber, the first membrane transmits the first pressure wave into the ink body contained in the second chamber. When the first membrane transmits the first pressure wave into the ink body, an ink droplet is ejected out the ink ejection nozzle. A second transducer is disposed in the first chamber and is also in communication with the working fluid for inducing a second pressure wave that flexes the membrane into the second chamber. When the membrane flexes into the second chamber, the membrane transmits the second pressure wave into the ink body contained in the second chamber in order to damp the first pressure wave that was transmitted into the second chamber. The second pressure wave is sufficient to interfere with and damp the first pressure wave but insufficient to cause ejection of another ink droplet. The tranducers themselves may be thermal resistors, electromagnets, piezoelectric actuators, or similar devices for transforming energy input of one form (i.e., heat or electricity) into energy output of another form (i.e., hydraulic or mechanical movement).

A feature of the present invention is the provision of a first transducer separated from the ink body by a membrane, the first transducer generating a first pressure wave to flex the membrane and thereby transmit the first pressure wave to the ink body in order to eject an ink drop from the ink body.

Another feature of the present invention is the provision of a second transducer separated from the ink body by the membrane and spaced-apart from the first transducer, the second transducer generating a second pressure wave to flex the membrane and thereby transmit the second pressure wave to the ink body in order to damp the first pressure wave in the ink body.

An advantage of the present invention is that printer speed is increased.

Another advantage of the present invention is that the effect of "decel" is reduced.

An additional advantage of the present invention is that use thereof reduces the phenomenon known as resistor "kogation".

Yet another advantage of the present invention is that resistor cavitation damage due to the combined effects of bubble collapse and corrosive inks are reduced.

Still another advantage of the present invention is that a wider variety of inks may be used for printing.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT(S)

The present invention will be directed in particular to elements forming part of, or cooperating more directly with, apparatus in accordance with the present invention. It is to be understood that elements not specifically shown or described may take various forms well known to those skilled in the art.

Figure 1:
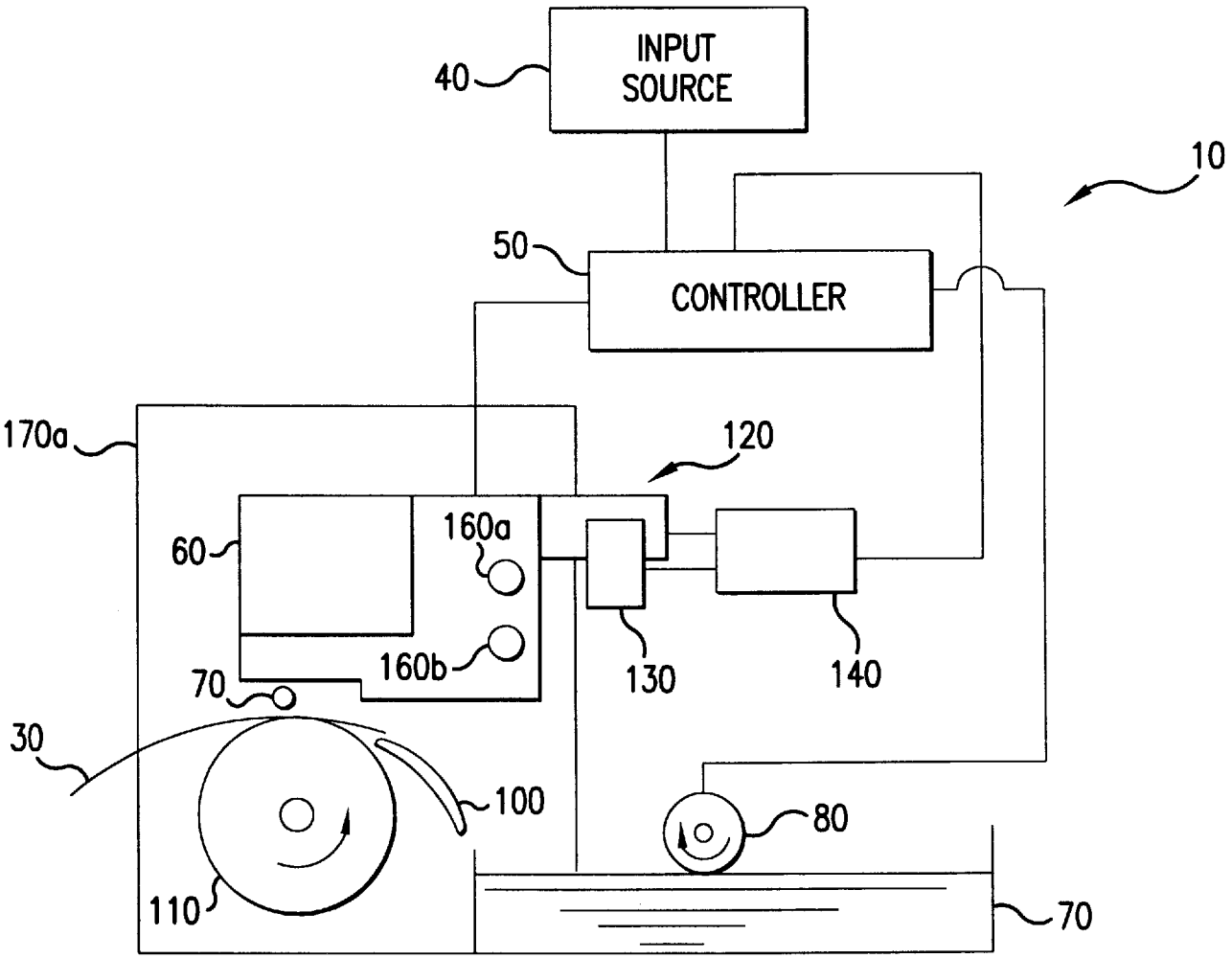
FIG. 1 is a view in elevation of a thermal ink jet printer with parts removed for clarity.
Figure 2:
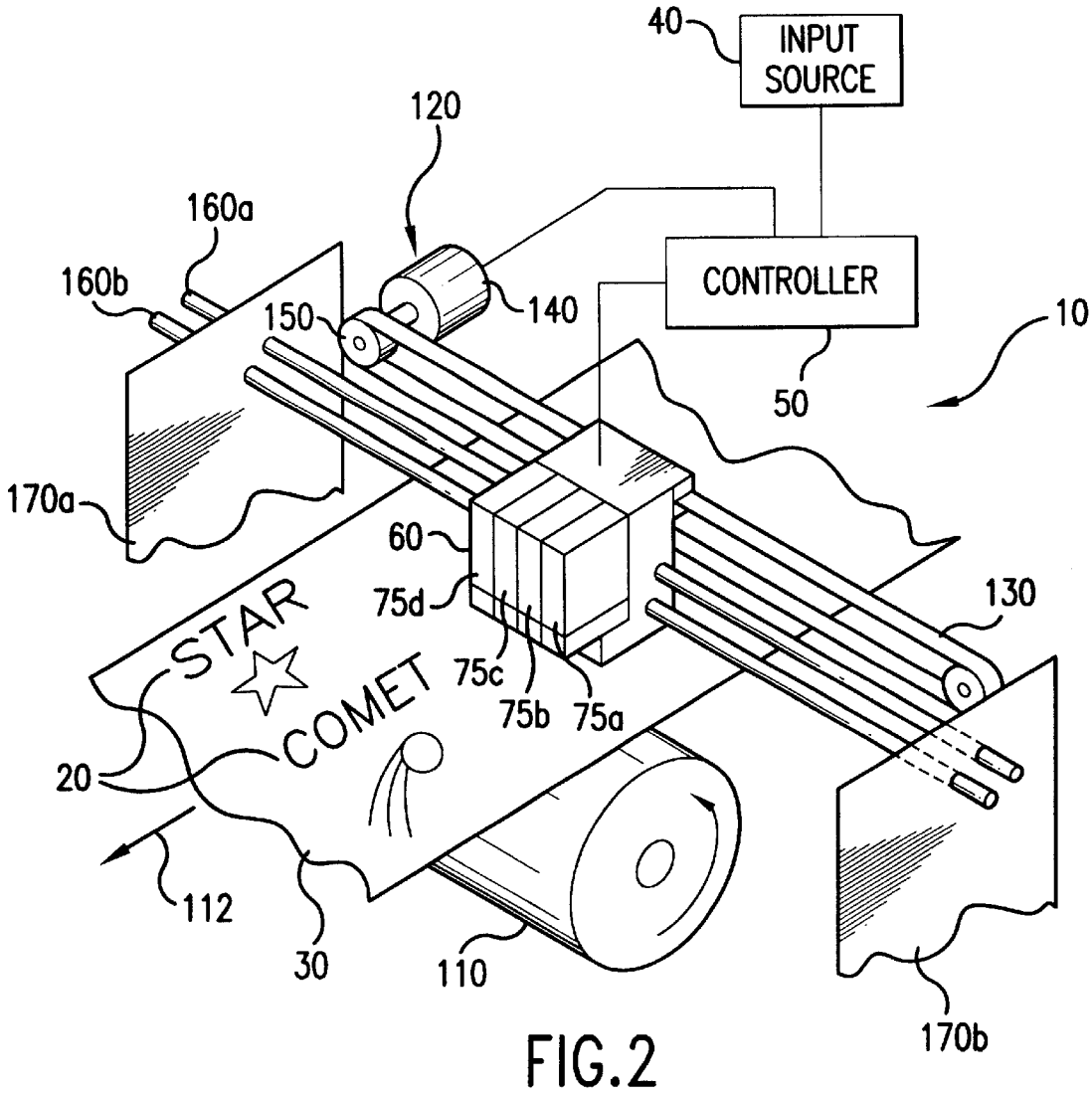
FIG. 2 is a view in perspective of the thermal ink jet printer printing an image on a receiver.

Therefore, referring to FIGS. 1 and 2, there is shown a thermal ink jet printer, generally referred to as 10, for printing an image 20 on a receiver 30. Receiver 30 may be paper or transparency or other material suitable for receiving image 20. Printer 10 comprises an input source 40 that provides raster image data or other form of digital image data. In this regard, input source 40 may be a computer, scanner, or facsimile machine.

Referring again to FIGS. 1 and 2, input source 40 generates an output signal that is received by a controller 50, which is coupled to input source 40. The controller 50 processes the output signal received from input source 40 and generates a controller output signal that is received by a thermal ink jet print head 60 coupled to controller 50. The controller 50 controls operation of print head 60 to eject an ink drop 70 therefrom in response to the output signal received from input source 40. Moreover, print head 60 may comprise a plurality of print head cartridges 75*a*, 75*b*, 75*c*, and 75*d* containing differently colored inks, which may be magenta, yellow, cyan and black, respectfully, for forming a full-color version of image 20.

Still referring to FIGS. 1 and 2, individual sheets of receiver 30 are fed from a supply bin, such as a sheet supply tray 70, by means of a picker mechanism 80. The picker mechanism 80 picks the individual sheets of receiver 30 from tray 70 and feeds the individual sheets of receiver 30 onto a guide 100 that is interposed between and aligned with print head 60 and picker mechanism 80. Guide 100 guides each sheet of receiver 30 into alignment with print head 60. Disposed opposite print head 60 is a rotatable platen roller 110 for supporting receiver 30 thereon and for transporting receiver 30 past print head 60, so that print head 60 may print image 20 on receiver 30. In this regard, platen roller 110 transports receiver 30 in direction of arrow 112.

Referring yet again to FIGS. 1 and 2, during printing, print head 60 is driven transversely with respect to receiver 30 preferably by means of a motorized continuous belt and pulley assembly, generally referred to as 120. The belt and pulley assembly 120 comprises a continuous belt 130 affixed to print head 60 and a motor 140 engaging belt 130. Belt 130 extends traversely across receiver 30, as shown, and motor 140 engages belt 130 by means of at least one pulley 150. As motor 140 rotates pulley 150, belt 130 also rotates. As belt 130 rotates, print head 60 traverses receiver 30 because print head 60 is affixed to belt 130, which extends traversely across receiver 30. Moreover, print head 60 is itself supported by slide bars 160*a* and 160*b* that slidably engage and support print head 60 as print head 60 traverses receiver 30. Slide bars 160*a* and 160*b* in turn are supported by a plurality of frame members 170*a* and 170*b* that are connected to ends of slide bars 160*a* and 160*b*. Of course, controller 50 may be coupled to picker mechanism 80, platen roller 110 and motor 140, as well as print head 60, for synchronously controlling operation of print head 60, picker mechanism 80, platen roller 110, and motor 140. Each time print head traverses receiver 30, a line of image information is printed onto receiver 30. After each line of image information is printed onto receiver 30, platen roller 110 is rotated in order to increment receiver 30 a predetermined distance in the direction of arrow 112. After receiver 30 is incremented the predetermined distance, print head 60 is again caused to traverse receiver 30 to print another line of image information. Image 20 is formed after all desired lines of printed information are printed on receiver 30. After image 20 is printed on receiver 30, the receiver 30 exits printer 10 to be deposited in an output bin (not shown) for retrieval by an operator of printer 10.

In the case of thermal ink jet printers, a heater element causes boiling of the ink in the print head to produce a steam bubble that in turn produces a pressure wave in the ink. This pressure wave squeezes a portion of the ink in the form of an ink droplet out the print head in order to produce a mark on the receiver. The steam bubble then collapses. Of course, if the time between actuations of the heater element is sufficiently long, the pressure wave naturally dies-out before each successive actuation of the heater element. Thus, in the prior art, each pressure wave is allowed to die-out before successive actuations of the heater element. This is so because it is known that actuation of the heater element before the previous pressure wave dies-out interferes with precise ejection of ink droplets from the print head, which leads to ink droplet placement errors and drop size variations. However, operating the printer in this manner reduces printing speed because ejection of an individual ink droplet must wait for the preexisting pressure wave to naturally die-out. Therefore, it is desirable to damp the pressure wave without waiting for the pressure wave to naturally die-out, so that printer speed increases.

Moreover, in the case of prior art thermal ink jet printers, the heating element typically is in direct contact with the ink in the print head in order to form the steam bubble. However, it has been observed that over time the ink droplet will "decel", thereby leading to a transient decrease in velocity and/or droplet volume. Also, heater element performance will decrease due to a phenomenon referred to in the art as "kogation", which limits the heater element's energy transfer efficiency to the ink and also limits operational lifetime of the heater element. In addition, bubble collapse can lead to cavitation damage to the heater element.

Further, if it were not for the requirement that the ink be vaporized (i.e., vaporization constraint), various ink components could be included in the ink formulation to enhance printing characteristics.

It is therefore desirable to solve the hereinabove recited problems of the prior art by providing a thermal ink jet printer that increases printer speed, reduces occurrence of "decel", reduces kogation, ameliorates cavitation damage to the heater element, and that does not require vaporization of the ink.

Figure 3:
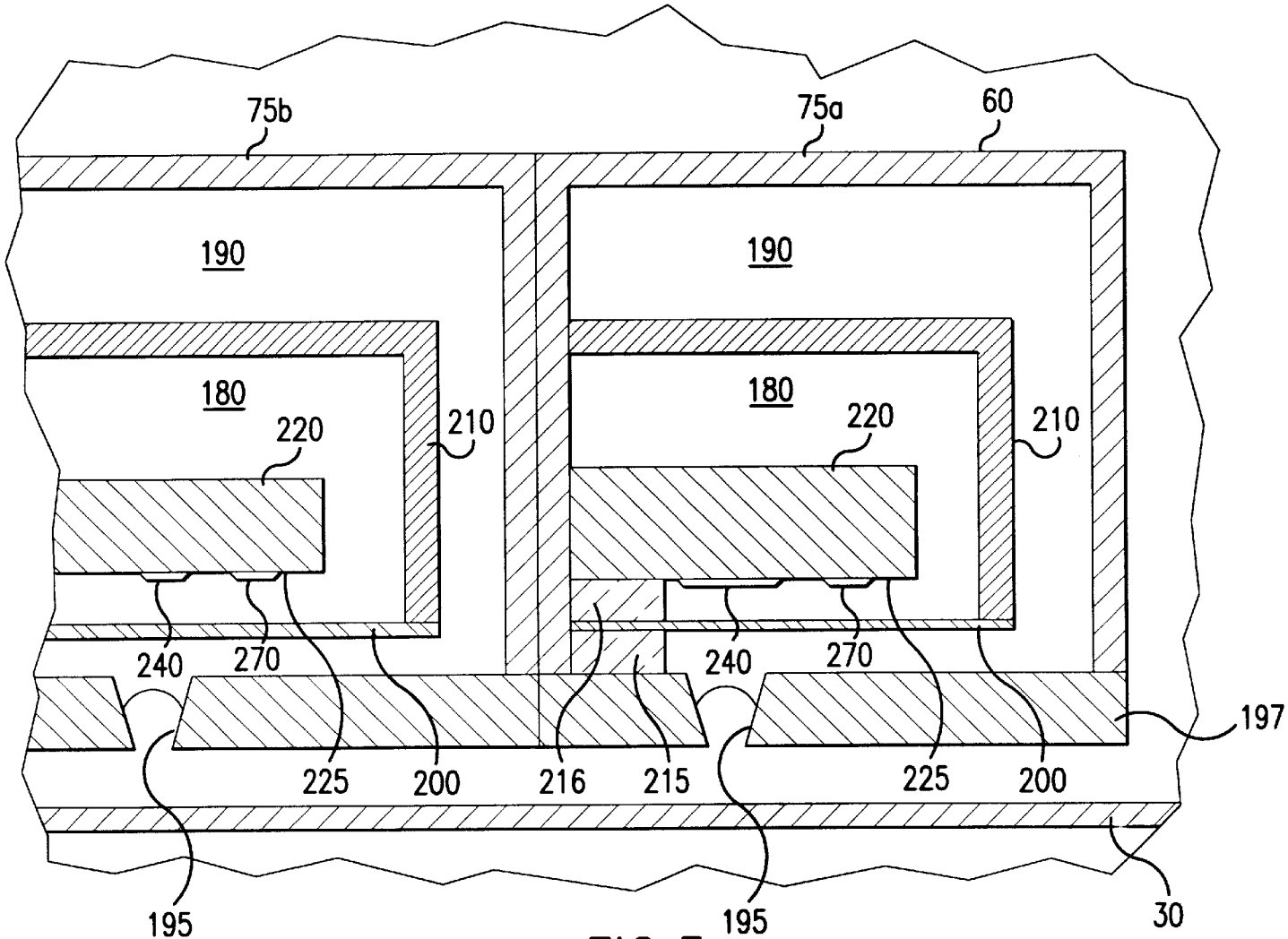
FIG. 3 is fragmentation view in elevation of a first embodiment thermally-activated ink jet print head belonging to the printer, the first embodiment print head comprising a plurality of print head cartridges each defining a first chamber and a second chamber separated by a first embodiment membrane, the first chamber having a first embodiment first transducer and a first embodiment second transducer disposed therein.
Figure 4:
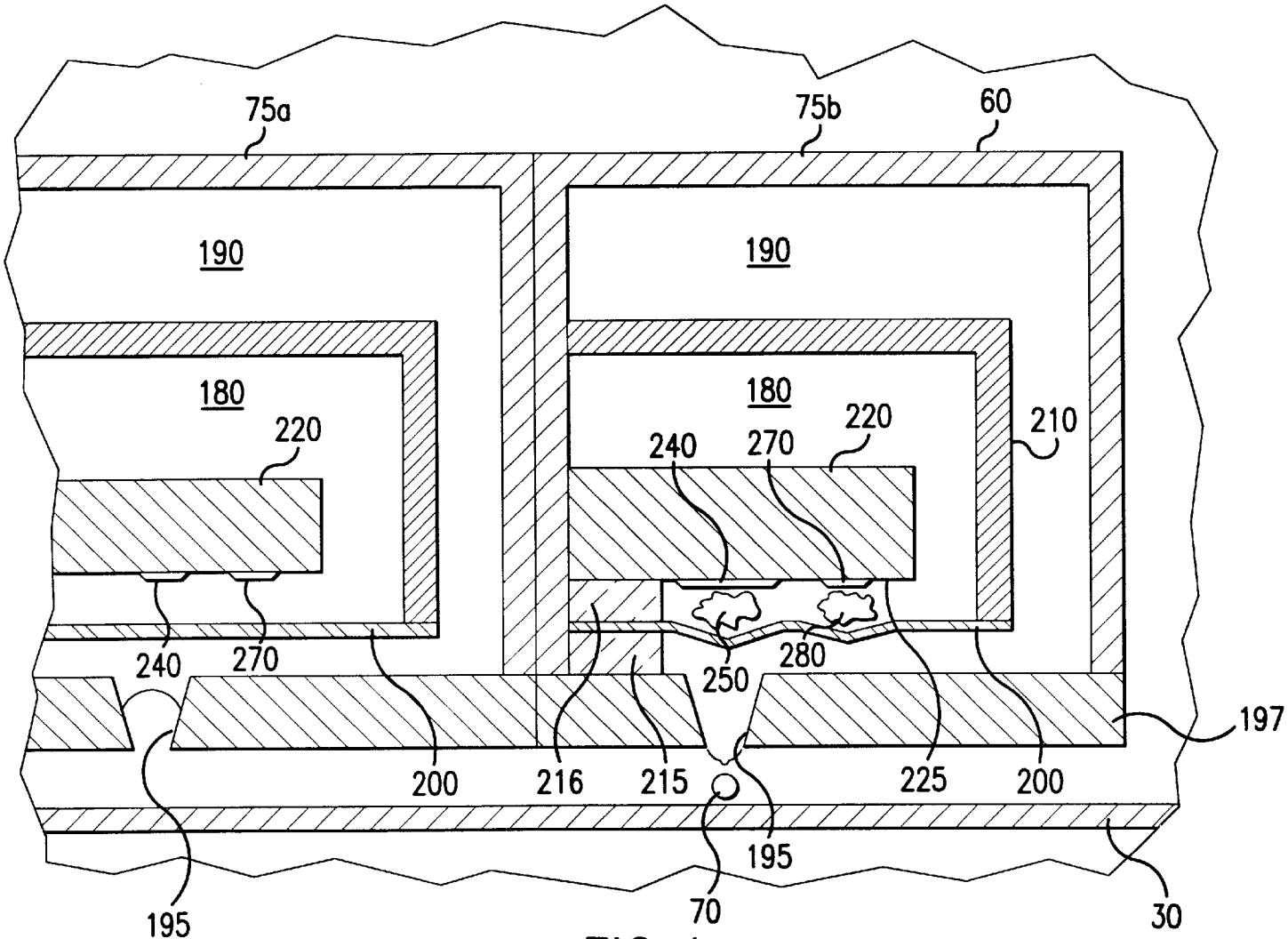
FIG. 4 is a fragmentation view in elevation of the first embodiment ink jet print head, this view also showing the first embodiment first transducer and the first embodiment second transducer being activated to deform the first embodiment membrane.
Figure 5A:
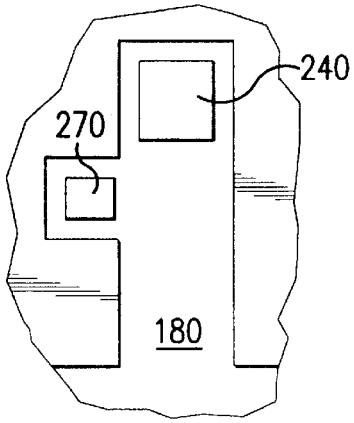
FIG. 5A is a fragmentation view in horizontal section of the first embodiment print head, this view also showing the first embodiment first transducer and the first embodiment second transducer.
Figure 5B:
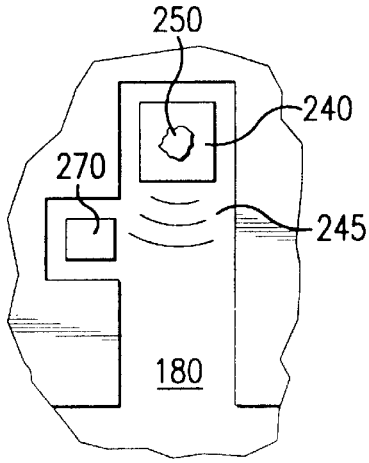
FIG. 5B is a fragmentation view in horizontal section of the first embodiment print head, this view also showing a first pressure wave induced by activation of the first embodiment first transducer.
Figure 5C:
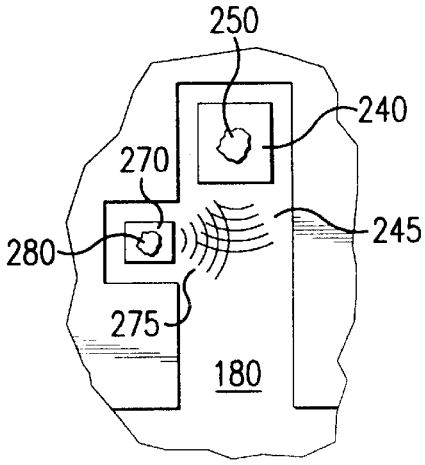
FIG. 5C is a fragmentation view in horizontal section of the first embodiment print head, this view also showing the first pressure wave induced by activation of the first embodiment first transducer and a second pressure wave induced by activation of the first embodiment second transducer, the second pressure wave interfering with the first pressure wave to damp the first pressure wave.
Figure 5D:
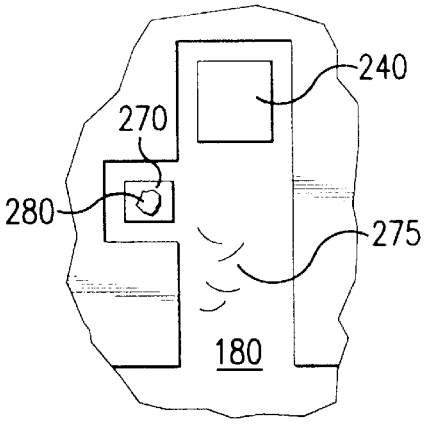
FIG. 5D is a fragmentation view in horizontal section of the first embodiment print head, this view also showing the second pressure wave after having damped the first pressure wave.
Figure 5E:
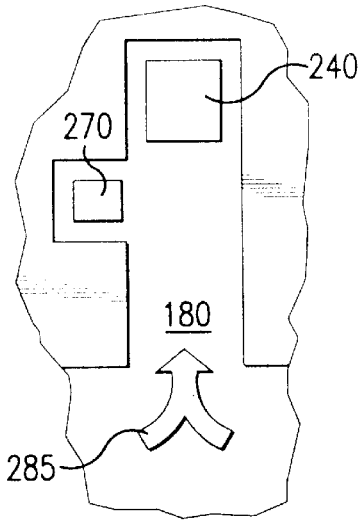
FIG. 5E is a fragmentation view in horizontal section of the first embodiment print head, this view also showing ink refilling the second chamber after the first and second transducers have been activated and after the first pressure wave has been damped.

Therefore, turning now to FIGS. 3 and 4, there is shown first embodiment print head 60 comprising the previously mentioned print head cartridges 75*a*/*b*/*c*/*d* (only cartridges 75*a*/*b* being shown) coupled side-by-side in tandem. Each of cartridges 75*a*/*b*/*c*/*d* belonging to print head 60 defines an elongate first chamber 180 and an elongate second chamber 190 therein. For reasons disclosed more fully hereinbelow, first chamber 180 is capable of receiving a working fluid, which may be an aqueous liquid, such as water. Moreover, the working fluid may be a so-called "engineered" fluid that optimizes nucleation factors, such as vapor bubble temperature, bubble formation speed, and force exerted on the thermal resistor due to bubble collapse. Second chamber 190, on the other hand, is capable of receiving an ink body from which image 20 will be formed. In addition, second chamber 190 has an outlet 195 for exit of ink drop 70 from print head 60. Outlet 195 is preferably formed in an orifice faceplate 197 spanning second chamber 190.

Referring again to FIGS. 3 and 4, a generally rectangularly-shaped flexible first embodiment first diaphragm or first membrane 200 separates first chamber 180 and second chamber 190. Membrane 200 is elastic for reasons provided hereinbelow. In this regard, membrane 200 may be made from any suitable corrosion-resistant elastic material, such as a natural or silicon rubber and may be approximately 0.5 to 1.5 micrometer thick in transverse cross-section. Membrane 200 is preferably corrosion-resistant to resist corrosive effects of the working fluid and the ink body. Membrane 200 is sealingly affixed along an edge portion thereof to an elongate support member 210 that extends between first chamber 180 and second chamber 190. Support member 210 supports membrane 200 and also serves to sealingly separate first chamber 180 and second chamber 190. Membrane 200 may be sealingly affixed to support member 210 by any suitable means, such as by a suitable heat-resistant and corrosion-resistant adhesive. Moreover, membrane 200 is sealingly affixed along other edges thereof to an elongate lower ledge 215 that preferably creates second chamber 190 so as to define the ink body firing chamber. In addition, membrane 200 is sealingly affixed along edges thereof to an elongate upper ledge 216 that preferably creates first chamber 180 so as to define the working fluid firing chamber. The material forming upper ledge 216 can be the same material that forms lower ledge 215. In this first embodiment print head 60, membrane 200 is positioned over outlet 195 but is spaced apart therefrom to allow space for flexing of membrane 200. Ledge 216 is sealingly connected to a horizontally-disposed die or rafter member 220. Rafter member 220, which is disposed in first chamber 180, has an underside 225 for reasons disclosed hereinbelow. Thus, it may be understood from the description hereinabove, that membrane 200, support member 210, and ledges 215/216 cooperate to sealingly separate first chamber 180 and second chamber 190 and define the firing chambers for the working fluid and ink, respectively. In other words, membrane 200, support member 210, and ledges 215/216 cooperate to sealingly separate the working fluid and the ink body, for reasons disclosed hereinbelow.

Referring to FIGS. 3, 4, 5A, 5B, 5C, 5D, and 5E, attached to underside 225 of rafter member 220 and therefore disposed in first chamber 180 is a first embodiment first transducer, which may be a first heater element or first resistor 240, for locally boiling the working fluid. First resistor 240 is electrically connected to controller 50, so that controller 50 controls flow of electrical energy to first resistor 240 in response to output signals received from input source 40. First resistor 240 is in fluid communication with the working fluid, and thus membrane 200, for inducing a first pressure wave 245 in the working fluid in order to flex membrane 200. In this regard, when electrical energy momentarily flows to first resistor 240, the first resistor 240 locally heats the working fluid causing a first vapor bubble 250 to form adjacent to first resistor 240. Vapor bubble 250 pressurizes first chamber 180 by displacing the working fluid and causes generation of first pressure wave 245 in first chamber 180. As first pressure wave 245 is generated in first chamber 180, membrane 200 flexes or distends to squeeze ink drop 70 from the ink body residing in second chamber 190 and force ink drop 70 through outlet 195, so that ink drop 70 will land on receiver 30. In other words, first pressure wave 145 generated in first chamber 180 flexes membrane 200, so that first pressure wave 245 is transmitted into second chamber 190 in order to pressurize second chamber 190. After a predetermined time and as ink drop 70 passes through outlet 195, controller 50 ceases supplying electrical energy to resistor 240. Vapor bubble 250 will thereafter collapse due to absence of energy input to the working fluid. As vapor bubble 250 collapses, elastic membrane 200 will tend to return to its unflexed position to await re-energization of resistor 240 to eject another ink drop 70. Also, as vapor bubble 250 collapses, the first pressure wave 245 propagates along elongate second chamber 190 in the working fluid as well as along first chamber 180 in the ink body.

Referring again to FIGS. 3, 4, 5A, 5B, 5C, 5D, and 5E, attached to underside 225 of rafter member 220 and therefore disposed in first chamber 180 is a first embodiment second transducer, which may be a second heater element or second resistor 270, for locally boiling the working fluid. First resistor 240 and second resistor 270 are off-set one to the other, as shown. The purpose of second resistor 270 is to damp first pressure wave 245 generated in both first chamber 180 containing the working fluid as well as in second chamber 190 containing the ink body. It is important to damp first pressure wave 245. This is important because, as previously mentioned, first resistor 240 generates first pressure wave 245 in first chamber 180 and the "sympathetic" pressure wave 245 in second chamber 190 by means of membrane 200, which first pressure wave 245 should be damped to increase printer speed by decreasing time between ejection of ink drops 70. In this regard, second resistor 270 is energized by controller 40 a predetermined time after energization of first resistor 240. To achieve this result, second resistor 270 is electrically connected to controller 50, so that controller 50 controls flow of electrical energy to second resistor 270. Second resistor 270 is in fluid communication with the working fluid and thus membrane 200 for inducing a second pressure wave 275 in the working fluid in order to flex membrane 200. In this regard, when electrical energy momentarily flows to second resistor 270, the second resistor 270 locally heats the working fluid causing a second vapor bubble 280 to form adjacent to second resistor 270. Second vapor bubble 280 pressurizes first chamber 180 by displacing the working fluid and causes generation of second pressure wave 275 in first chamber 180. As second pressure wave 275 is generated in first chamber 180, membrane 200 flexes or distends. In other words, second pressure wave 275 generated in first chamber 180 flexes membrane 200, so that second pressure wave 275 is transmitted into second chamber 190 in order to pressurize second chamber 190. A predetermined time after second chamber 190 is pressurized, controller 50 ceases supplying electrical energy to second resistor 270. Second vapor bubble 280 will thereafter collapse due to absence of energy input to the working fluid. As second vapor bubble 280 collapses, elastic membrane 200 will tend to return to its unflexed position to await re-energization of second resistor 270 to damp another first pressure wave 245. As may be appreciated from the description hereinabove, second pressure wave 275 interferes with propagation of first pressure wave 245 along both first chamber 180 and second chamber 190. As second pressure wave 275 interferes with first pressure wave 245, first pressure wave 245 is substantially abated and force, momentum and speed of first pressure wave 245 is reduced (i.e., damped). Thus, re-energization of resistor 240 need not wait for first pressure wave 245 to naturally die-out. Rather, the hydraulic force of second pressure wave 275 damps hydraulic force of first pressure wave 245, so that resistor 240 may be energized sooner, thereby increasing printer speed. After ejection of ink drop 70, second chamber 190 is refilled with ink from an ink supply (not shown) as represented by an arrow 285.

Figure 6:
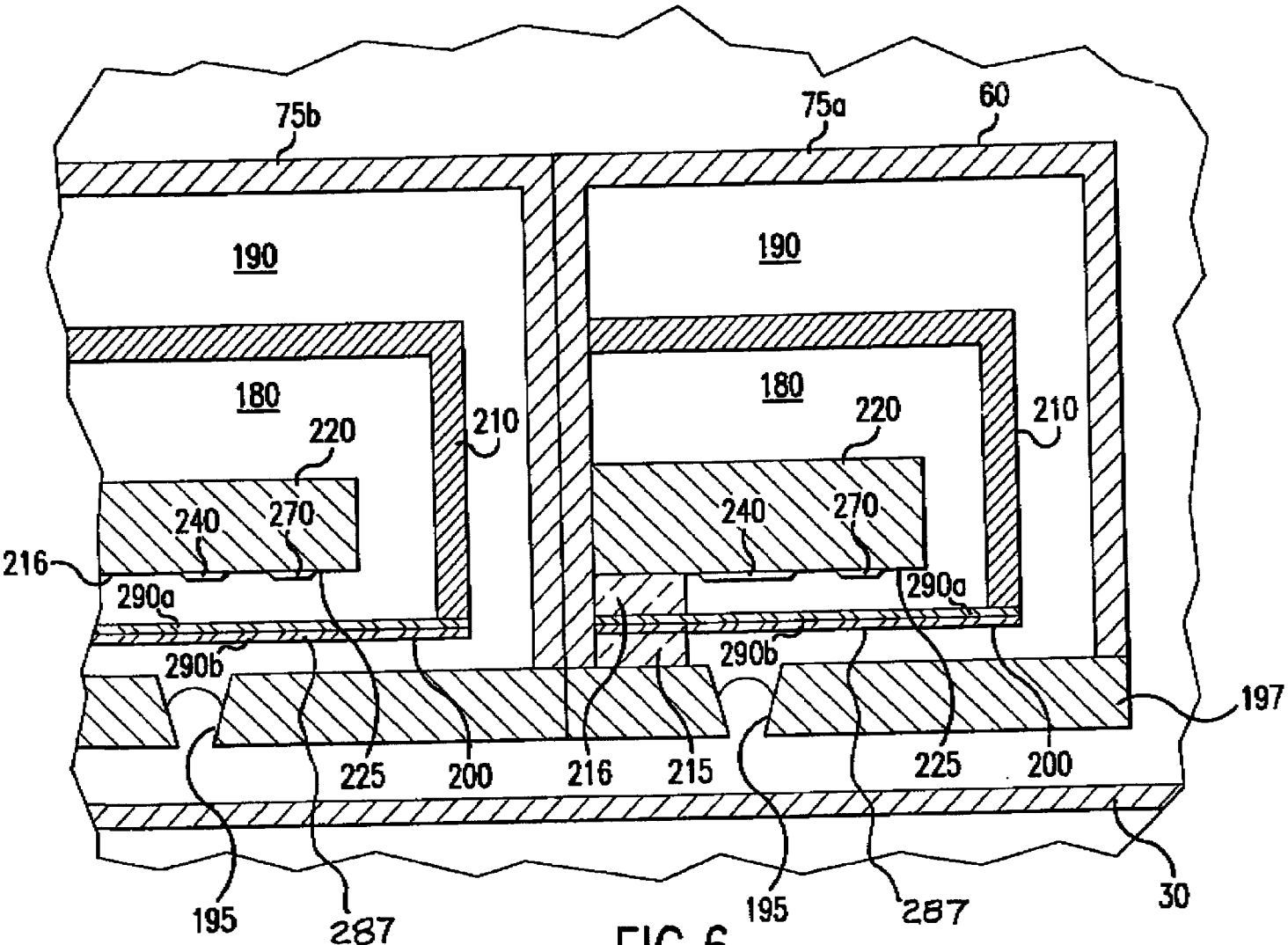
FIG. 6 is a fragmentation view in elevation of the first embodiment print head, this view also showing a second embodiment membrane.

Referring to FIG. 6, there is shown a second embodiment elastic membrane 287. Membrane 287 comprises a plurality of layers 290*a* and 290*b* constructed of predetermined elastic materials. In this regard, layers 290*a* and 290*b* may be made of an elastic natural or silicone rubber, each layer 290*a* and 290*b* having a different coefficient of elasticity for achieving a desired amount of asymmetric flexing of membrane 280.

Figure 7:
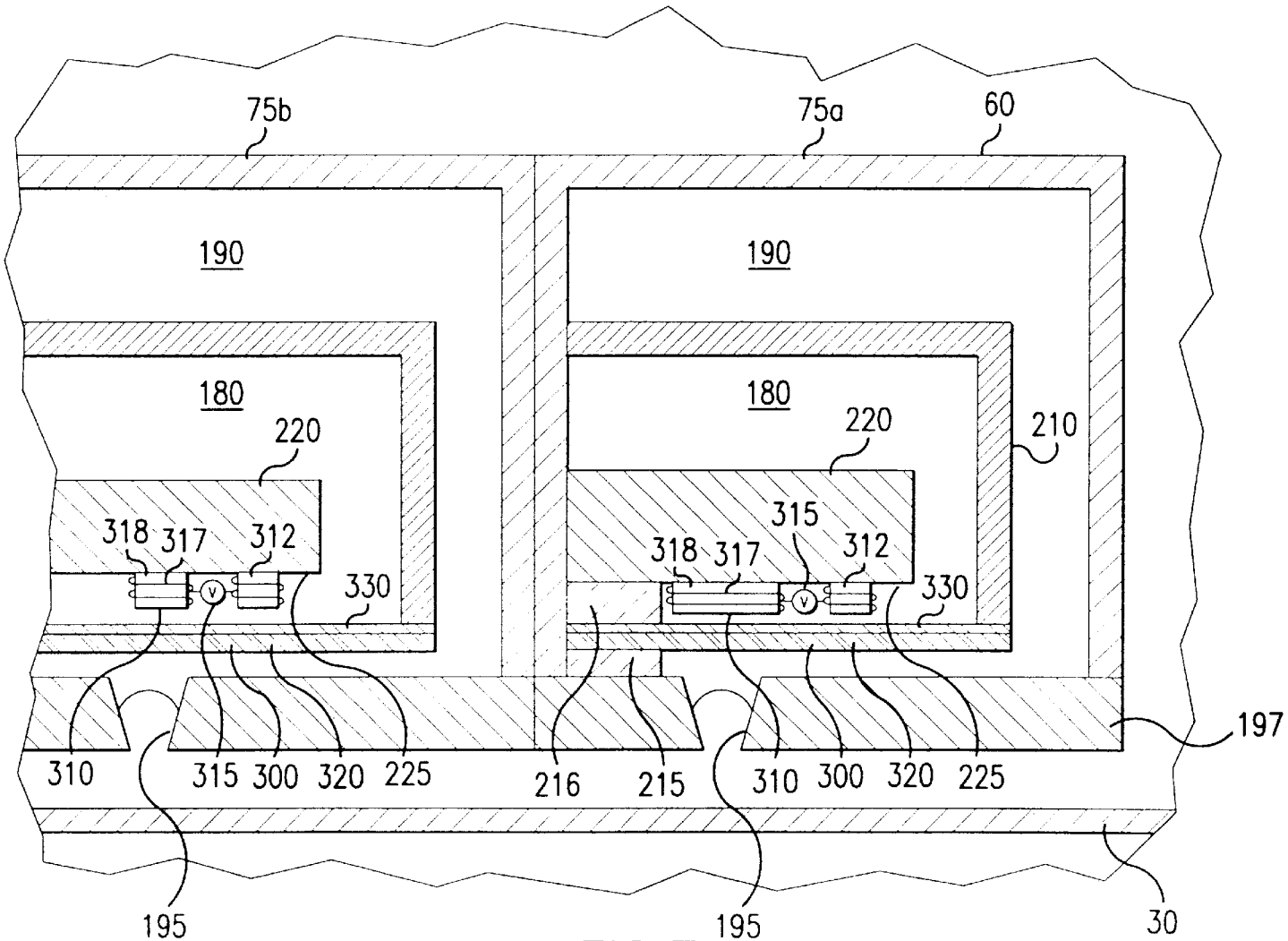
FIG. 7 is a fragmentation view in elevation of the first embodiment print head, this view also showing a third embodiment membrane and further showing a second embodiment first transducer and a second embodiment second transducer.
Figure 8:
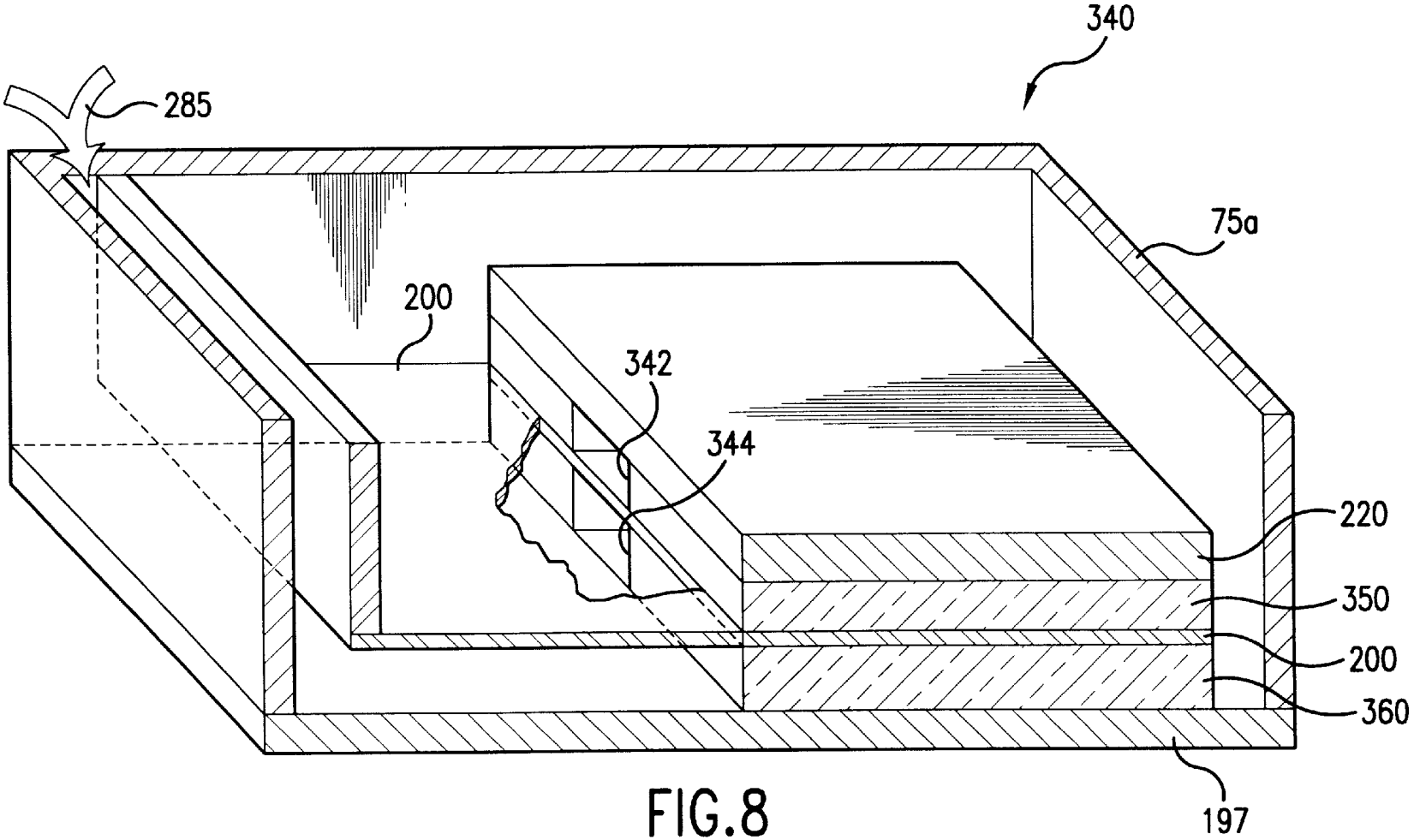
FIG. 8 is a perspective sectional view in elevation of a print head cartridge belonging to a second embodiment print head.
Figure 9:
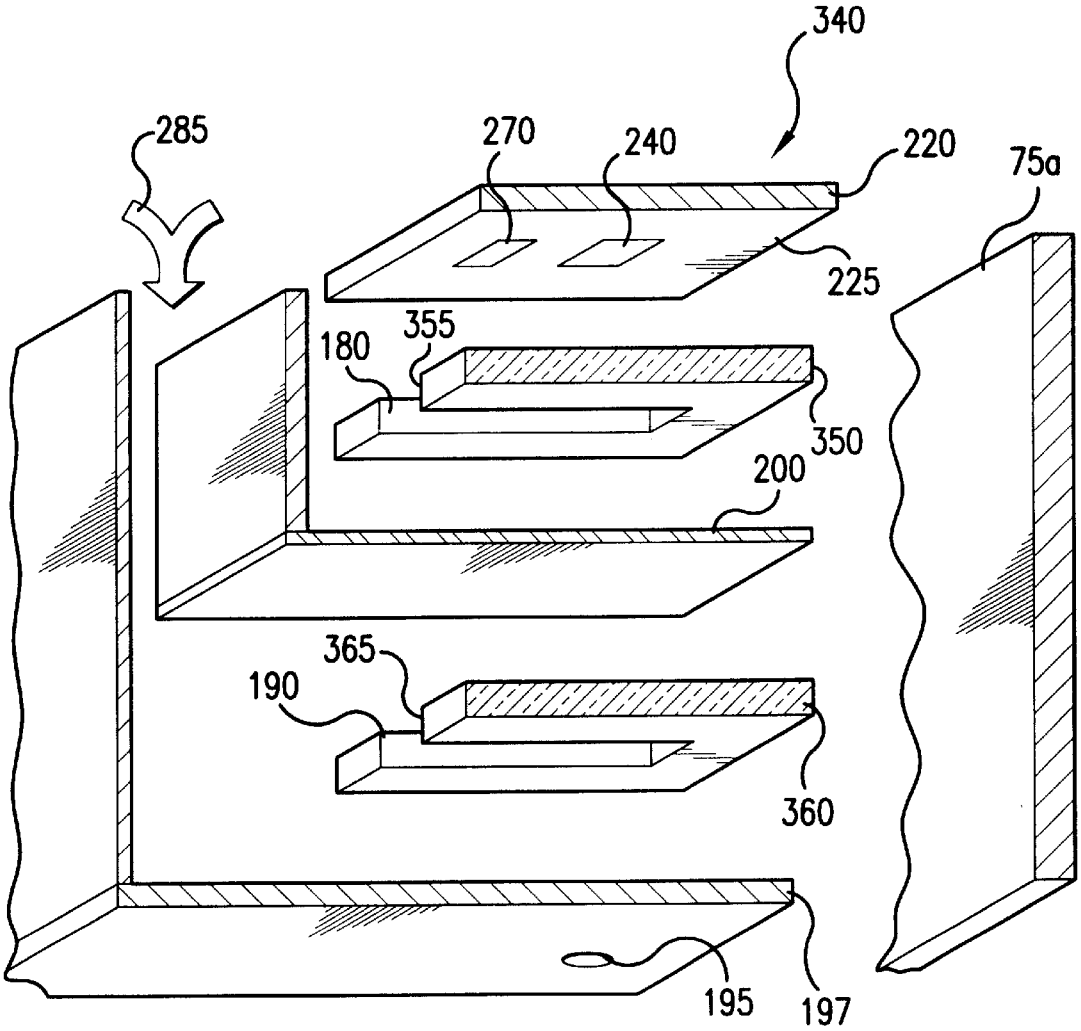
FIG. 9 is an exploded view in elevation of the print head cartridge belonging to the second embodiment print head.
Figure 10A:
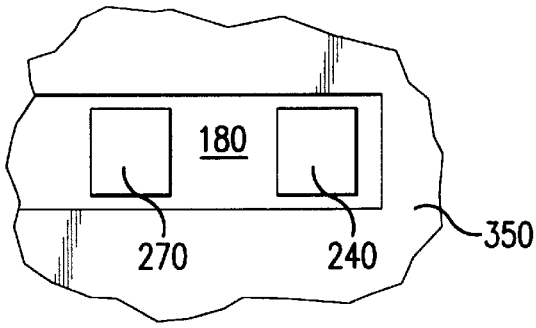
FIG. 10A is a fragmentation view in horizontal section of the second embodiment print head, this view also showing the first embodiment first transducer and the first embodiment second transducer.
Figure 10B:
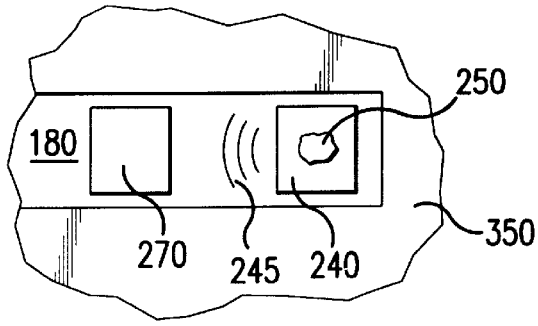
FIG. 10B is a fragmentation view in horizontal section of the second embodiment print head, this view also showing a first pressure wave induced by activation of the first embodiment first transducer.
Figure 10C:
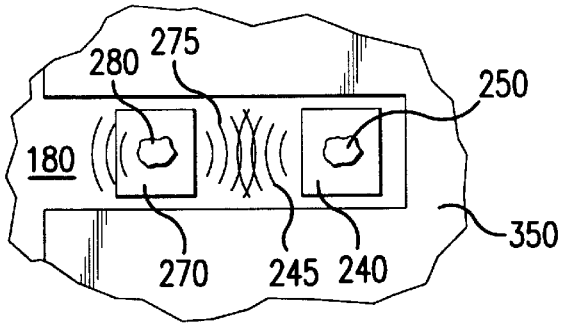
FIG. 10C is a fragmentation view in horizontal section of the second embodiment print head, this view also showing the first pressure wave and a second pressure wave induced by activation of the first embodiment second transducer, the second pressure wave interfering with the first pressure wave to damp the first pressure wave.
Figure 10D:
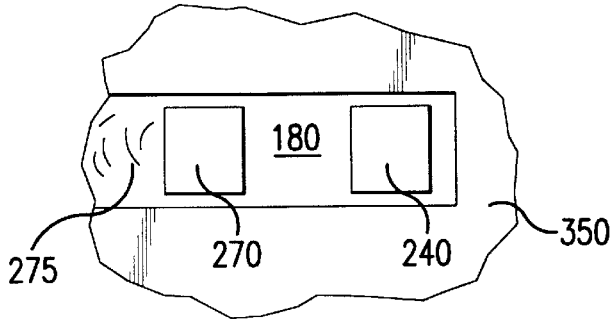
FIG. 10D is a fragmentation view in horizontal section of the second embodiment print head, this view also showing the second pressure wave after having damped the first pressure wave.
Figure 10E:
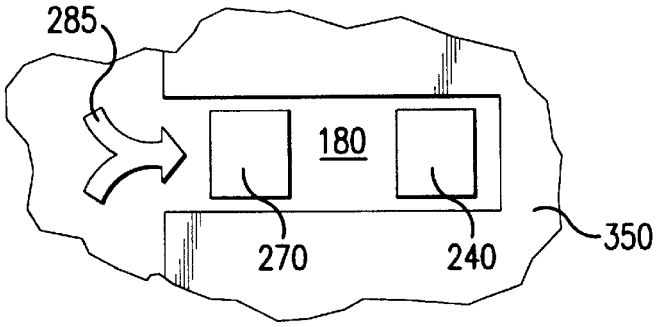
FIG. 10E is a fragmentation view in horizontal section of the second embodiment print head, this view also showing ink refilling the second chamber after the first and second transducers have been activated and after the first pressure wave has been damped.
Figure 11:
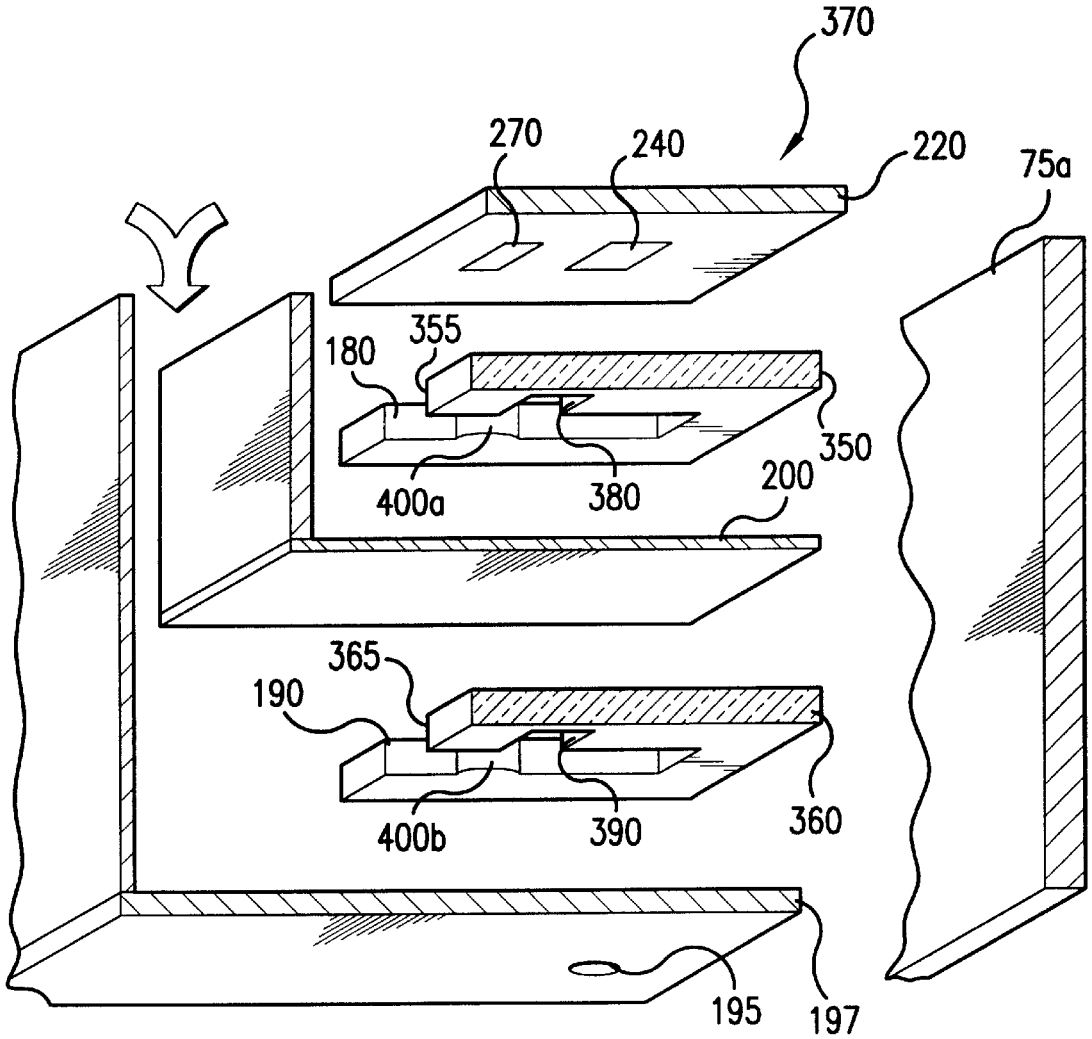
FIG. 11 is an exploded view in elevation of a print head cartridge belonging to a third embodiment print head, the print head cartridge having a "pinch point"
Figure 12A:
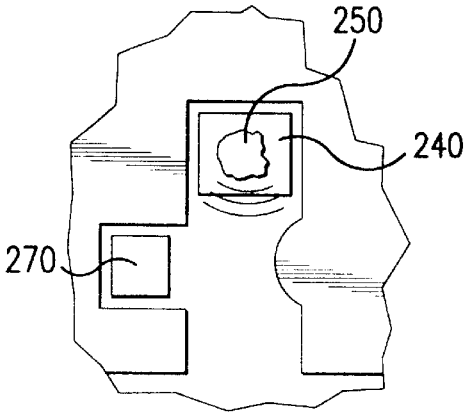
FIG. 12A is a fragmentation view in horizontal section of the third embodiment print head, this view also showing a first pressure wave induced by activation of the first embodiment first transducer.
Figure 12B:
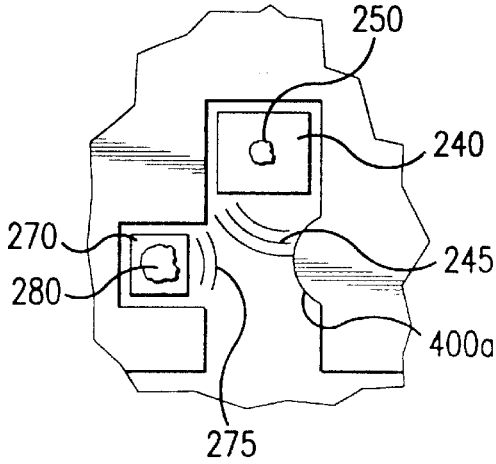
FIG. 12B is a fragmentation view in horizontal section of the third embodiment print head, this view also showing the first pressure wave and a second pressure wave induced by activation of the first embodiment second transducer.
Figure 12C:
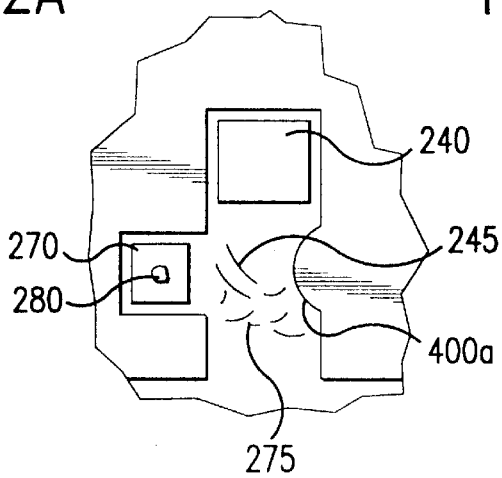
FIG. 12C is a fragmentation view in horizontal section of the third embodiment print head, this view also showing the second pressure wave and "pinch point" interfering with the first pressure wave to damp the first pressure wave.
Figure 12D:
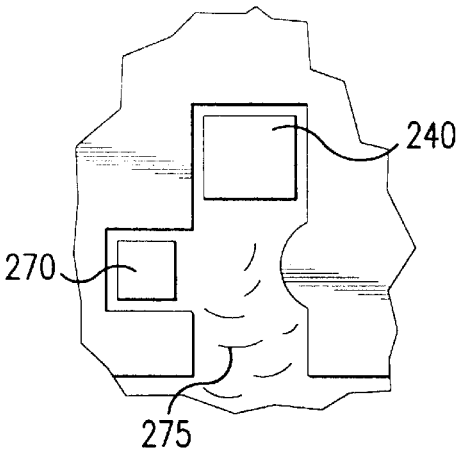
FIG. 12D is a view in horizontal section of the third embodiment print head, this view also showing the second pressure wave after having damped the first pressure wave.
Figure 12E:
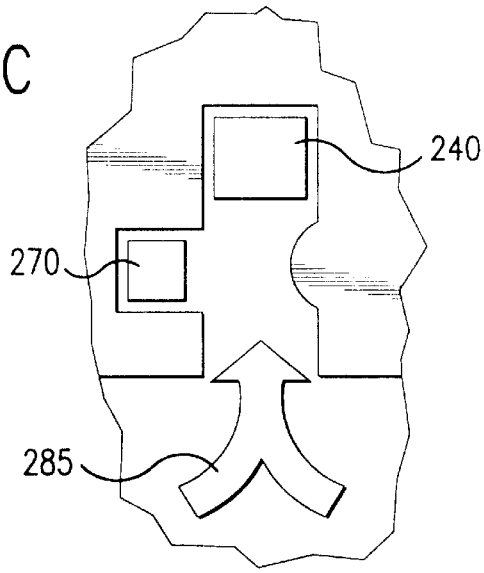
FIG. 12E is a plan view in horizontal section of the third embodiment print head, this view also showing ink refilling the second chamber after the first and second transducers have been activated and after the first pressure wave has been damped.

Referring to FIG. 7, there is shown a third embodiment membrane 300. Moreover, in this embodiment of the present invention, a plurality of second embodiment transducers is also provided. Each second embodiment transducer comprises a first electromagnet 310 and a second electromagnet 312 both connected to a voltage source 315. Voltage source 315 is in turn connected to controller 40 for controlling operation of electromagnets 310/312. Each electromagnet 310/312 includes a metal core 317. Each electromagnet 310/312 also includes an electrical conductor wire 318 that is capable of carrying an electrical charge and that is wound about core 317. Membrane 300 includes a flexible substrate 320, which may be made from natural or silicone rubber, to which is coupled a metallic layer 330 that is responsive to an electromagnetic force generated by electromagnets 310/312. The material and thickness of metallic layer 330 are chosen so that metallic layer 330 will outwardly flex toward outlet 75 when electromagnetic force is applied to metallic layer 330. However, as metallic layer 330 flexes, elastic substrate 320 will simultaneously flex in the same direction and the same amount because substrate 320 is coupled to metallic layer 330. When first electromagnet 310 is energized, the flexing of membrane 300 causes first pressure wave 245 to be induced in the ink body residing in second chamber 190 to cause ink drop 70 to exit outlet 195. Moreover, elastic layer 320, as well as metallic layer 330 coupled thereto, will returned its unflexed state after ejection of ink drop 70 due to the elastic nature of substrate 320. In addition, when second electromagnet 312 is energized, the flexing of membrane 300 causes second pressure wave 275 to be induced in the ink body residing in second chamber 190 in order to damp first pressure wave 245 in the manner previously mentioned. Of course, this embodiment of the present invention does not require the working fluid to be present. Thus, an advantage of this embodiment of the invention is that need for working fluid is eliminated.

Referring to FIGS. 8, 9, 10A, 10B, 10C, 10D and 10E, there is shown ink cartridge 75*a* belonging to a second embodiment print head, generally referred to as 340. In this regard, first resistor 240 and second resistor 270 are collinearly aligned and affixed to underside 225 of rafter member 220. Collinearly aligning first resistor 240 and second resistor 270 may facilitate construction of print head 340. Moreover, print head 340 includes an upper barrier member 350 defining first chamber 180 therein. Upper barrier member 350 also defines a first inlet 355 in communication with first chamber 180 for ingress of the working fluid into first chamber 180. In addition, print head 340 further includes a lower barrier member 360 defining second chamber 190 therein. Lower barrier member 360 also defines a second inlet 365 in communication with second chamber 190 for ingress of the ink into second chamber 190. First chamber 180 is vertically and collinearly aligned with second chamber 190. Moreover, membrane 200 is interposed between upper barrier member 350 and lower barrier member 360.

Referring to FIGS. 11, 12A, 12B, 12C, 12D and 12E, there is shown ink cartridge 75*a* belonging to a third embodiment print head, generally referred to as 370. In this regard, a first alcove or first blind cavity 380 is in communication with first chamber 180, but is off-set from first chamber 180. Also, a second alcove or second blind cavity 390 is in communication with second chamber 190, but is off-set from second chamber 190. Previously mentioned first resistor 240 is disposed in first chamber 180 while second resistor 270 is disposed in first blind cavity 380. Thus, first resistor 240 and second resistor 270 are off-set from each other. As first resistor 240 heats the working fluid in first chamber 180, vapor bubble 250 forms to flex membrane 200 in order to eject ink drop 70 out outlet 195. Of course, as membrane 200 flexes, first pressure wave 245 propagates along second chamber 190. Moreover, second resistor 270 is also disposed in first cavity 380 for flexing membrane 200, which is in fluid communication with second cavity 190. Second resistor 270 is actuated to produce second pressure wave 275 in second cavity 390 in order to damp first pressure wave 245. Preferably, second resistor 270 is actuated before first pressure wave 245 passes second blind cavity 390, so that first pressure wave 245 is precluded from entering cavity 390. Moreover, according to this embodiment of the present invention, both first chamber 180 and second chamber 190 are provided with a "pinch point" 400*a* and 400*b*, respectively. In this regard, pinch points 400*a*/*b* are formed in upper barrier 350 and lower barrier member 360, respectively. The purpose of pinch points 400*a*/*b* is to create an obstacle in the path of first pressure wave 245 in order to further damp first pressure wave 245. Thus, it may be understood that third embodiment print head 370 is substantially similar to second embodiment print head 340, except for the off-set of blind cavities 380/390, presence of resistors 270 and the addition of pinch points 400*a*/400*b*.

Figure 13:
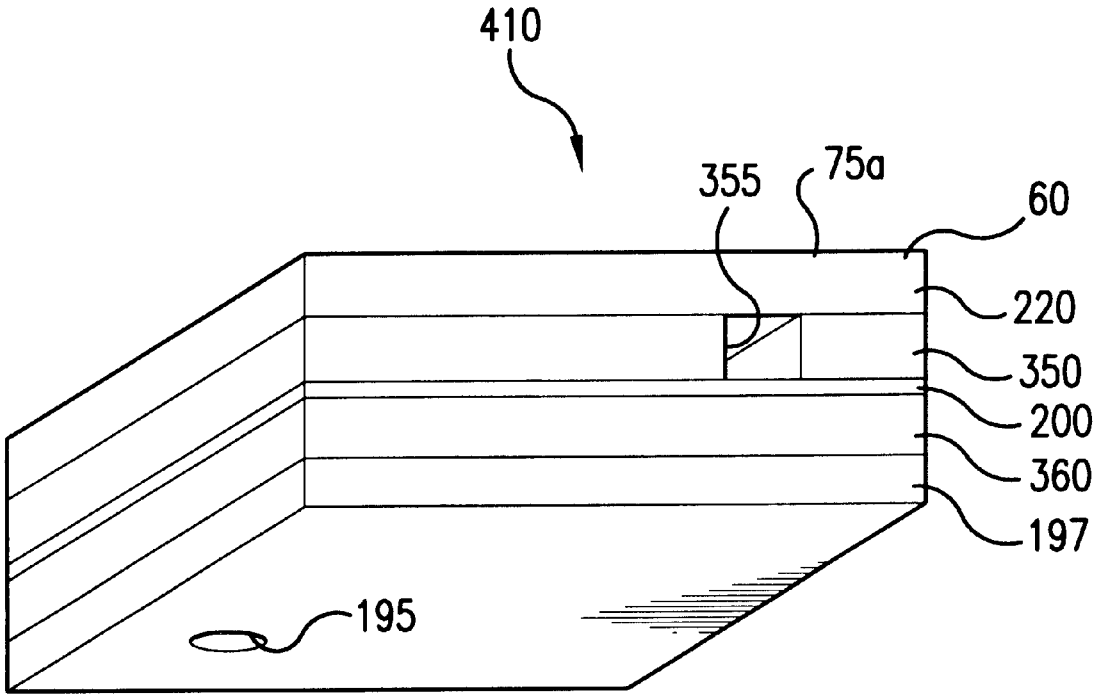
FIG. 13 is a view in perspective of a fourth embodiment print head.
Figure 14:
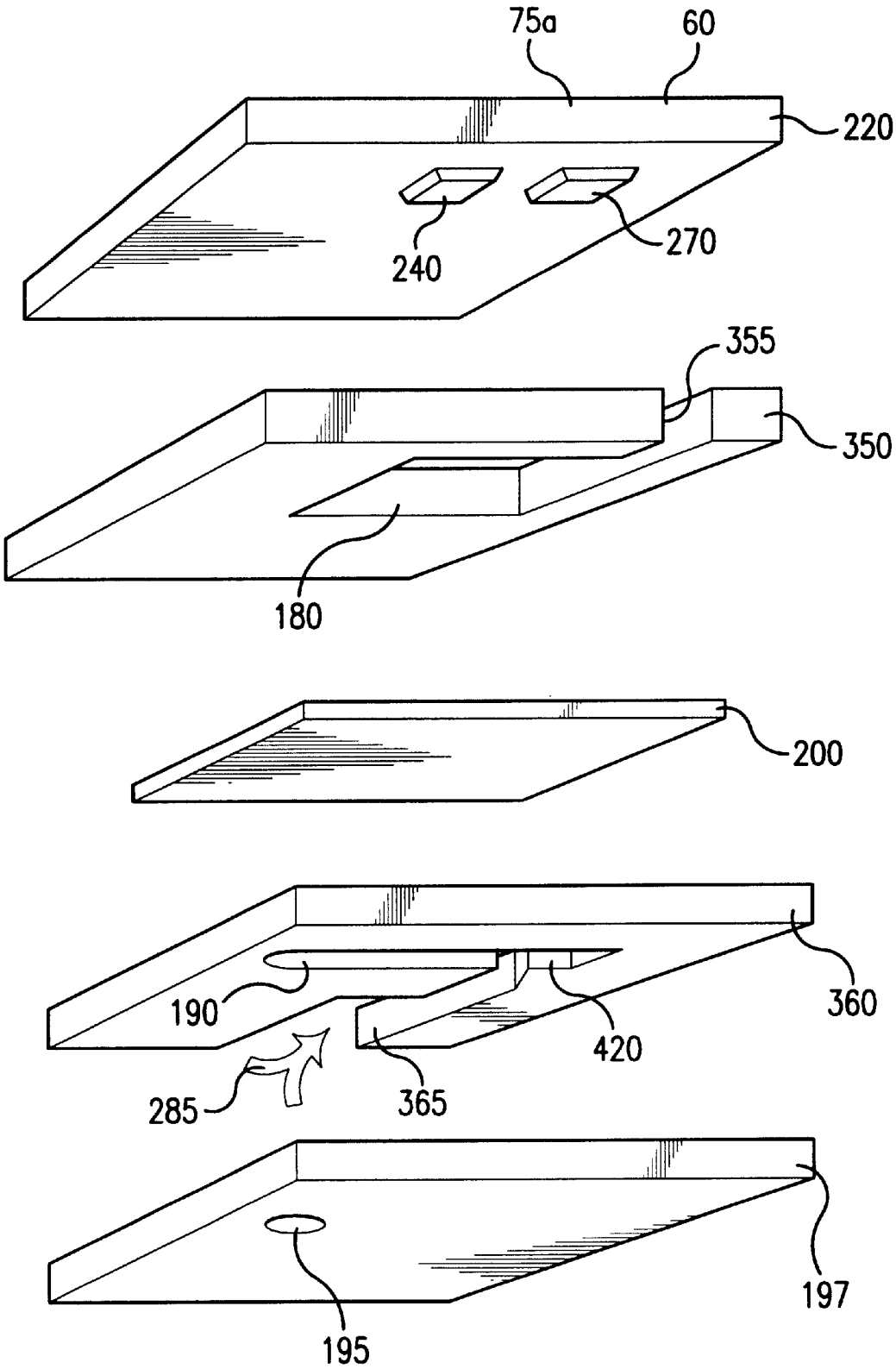
FIG. 14 is an exploded view in perspective of the fourth embodiment print head.

Referring to FIGS. 13 and 14, there is shown ink cartridge 75*a* belonging to a fourth embodiment print head, generally referred to as 410. Fourth embodiment print head 410 is substantially similar to third embodiment print head 370. However, according to this fourth embodiment print head 410, first resistor 240 and second resistor 270 are off-set from outlet 195 and second chamber 190 includes a pinch-point 420 for obstructing first pressure wave 245 in order to damp first pressure wave 245 in second chamber 190. According to this embodiment of the present invention, print head 410 is capable of controlling ink droplet volume as well as damping first pressure wave 245. It may be appreciated by a person of ordinary skill in the art that this fourth embodiment of the invention will produce a plurality of different ink drop volumes (i.e., ink drop sizes) depending on the number and size of resistors present ad the firing combinations possible. Larger drop weights can be generated by timing the resistor firing events to amplify the pressure waves instead of damping them out as described in previously mentioned embodiments herein.

An advantage of the present invention is that printer speed is increased. This is so because there is no longer a need to wait for the first pressure wave to naturally die-out before re-actuating the transducer (e.g., resistor or electromagnet) that is used to successively eject ink drops.

Another advantage of the present invention is that the effect of "decel" is reduced. This is so because, although the effect of "decel" is not fully understood, it has been observed that separation of the ink body from the resistor by presence of the membrane reduces the effect of "decel".

An additional advantage of the present invention is that use thereof reduces the phenomenon known as resistor "kogation". This is so because the ink body is separated from the resistor and therefore cannot chemically react with the resistor.

Yet another advantage of the present invention is that resistor cavitation damage due to the combined effects of bubble collapse and corrosive inks is reduced. This is so because the ink body is separated from the resistor.

Still another advantage of the present invention is that a wider variety of inks may be used. This is so because the ink vaporization constraint can be relaxed so that less soluble components, such as pigments, or polymers, can be included at higher concentrations in the ink. Moreover, relaxing the thermal or vaporization constraint may allow use of inks with significantly different bulk properties.

While the invention has been described with particular reference to its preferred embodiments, it will be understood by those skilled in the art that various changes may be made and equivalents may be substituted for elements of the preferred embodiments without departing from the invention. For example, the invention is suitable for use in a piezoelectric ink jet printer as well as in a thermal ink jet printer. To effect this result, one or more piezoelectric transducers may be used rather that thermal resistors or electromagnets in order to produce the first pressure wave and the second pressure wave.

Therefore, what is provided is a thermal ink jet printer for printing an image on a receiver and method of assembling the printer, the printer being adapted for high speed printing and increased thermal resistor lifetime.

Parts List

10 . . . thermal ink jet printer
20 . . . image
30 . . . receiver
40 . . . input source
50 . . . controller
60 . . . thermal ink jet print head
70 . . . sheet supply tray
75*a/b/c/d* . . . print head cartridges
80 . . . picker mechanism
100 . . . guide
110 . . . platen roller
112 . . . arrow (direction of receiver advance)
120 . . . belt and pulley assembly
130 . . . belt
140 . . . motor
150 . . . pulley
160*a/b* . . . slide bars
170*a/b* . . . frame members
180 . . . first chamber
190 . . . second chamber
195 . . . outlet
197 . . . faceplate
200 . . . first embodiment first membrane
210 . . . support member
215 . . . upper ledge
216 . . . lower ledge
220 . . . rafter member
225 . . . underside of rafter member
240 . . . first embodiment of the first transducer (i.e. first heater clement or first resistor)
245 . . . first pressure wave
250 . . . first vapor bubble
270 . . . first embodiment of the second transducer (i.e. second heater or second resistor)
275 . . . second pressure wave
280 . . . second vapor bubble
285 . . . arrow (representing ink refill direction)
287 . . . second embodiment membrane
290*a/b* . . . layers of second embodiment membrane
300 . . . third embodiment membrane
310 . . . first electromagnet
312 . . . second electromagnet
315 . . . voltage source
317 . . . metal core
318 . . . electrical conductor
320 . . . substrate
330 . . . metallic layer
340 . . . second embodiment print head
350 . . . upper barrier member
355 . . . first inlet
360 . . . lower barrier member
370 . . . third embodiment print head
380 . . . first blind cavity
390 . . . second blind cavity
400*a/b* . . . pinch points
410 . . . fourth embodiment print head
420 . . . pinch point

What is claimed is:

1. A thermal ink jet printer for printing an image on a receiver, comprising:

a. a print head defining a first chamber therein for receiving working fluid and defining a second chamber therein;

b. a flexible membrane separating the first chamber and the second chamber;

c. a first transducer in communication with the working fluid in the first chamber for inducing a first pressure wave in the working fluid in the first chamber, so that said membrane flexes into the second chamber; and d. a second transducer in communication with the working fluid in the first chamber for inducing a second pressure wave in the working fluid in the first chamber, so that said membrane flexes into the second chamber.

2. A thermal ink jet printer for printing an image on a receiver, comprising:

a. a print head defining a first chamber therein for receiving a working fluid and defining a second chamber therein;

b. a flexible membrane separating the first chamber and the second chamber;

c. a first transducer in communication with the working fluid for inducing a first pressure wave in the working fluid flexing said membrane into the second chamber, so that said membrane transmits the first pressure wave into the second chamber; and d. a second transducer in communication with the working fluid for inducing a second pressure wave in the working fluid flexing said membrane into the second chamber, so that said membrane transmits the second pressure wave into the second chamber to damp the first pressure wave transmitted into the second chamber.

3. A thermal ink jet printer for printing an image on a receiver, comprising:

a. a print head defining a first chamber therein for receiving a working fluid and defining a second chamber therein;

b. a flexible membrane separating the first chamber and the second chamber;

c. a first transducer disposed in the first chamber and in communication with the working fluid for inducing a first pressure wave in the working fluid flexing said membrane into the second chamber, so that said membrane transmits the first pressure wave into the second chamber; and d. a second transducer disposed in the first chamber and in communication with the working fluid for inducing a second pressure wave in the working fluid flexing said membrane into the second chamber, so that said membrane transmits the second pressure wave into the second chamber to damp the first pressure wave transmitted into the second chamber.

4. The printer of claim 3, wherein said first transducer comprises a resistor in communication with the working fluid.

5. The printer of claim 3, wherein said second transducer comprises a resistor in communication with the working fluid.

6. A thermal ink jet printer for printing an image on a receiver, comprising:

a. a print head defining a first chamber and a second chamber therein for receiving a working fluid and an ink body, respectively, the second chamber having an outlet;

b. a flexible membrane separating the first chamber and the second chamber;

a. a first transducer disposed in the first chamber and in fluid communication with the working fluid for inducing a first pressure wave in the working fluid to thereby flex said membrane into the second chamber, so that said membrane transmits the first pressure wave into the ink body to separate an ink drop from the ink body, the ink drop exiting the outlet to be intercepted by the receiver to print the image on the receiver; and d. a second transducer disposed in the first chamber and in fluid communication with the working fluid for inducing a second pressure wave in the working fluid to thereby flex said membrane into the second chamber, so that said membrane transmits the second pressure wave into the ink body to damp the first pressure wave transmitted into the ink body.

7. The printer of claim 6, wherein said first transducer comprises a thermal resistor for boiling the working fluid to generate an expansion force acting on said membrane to flex said membrane.

8. The printer of claim 6, wherein said second transducer comprises a thermal resistor for boiling the working fluid to generate an expansion force acting on said membrane to flex said membrane.

9. A print head for printing an image on a receiver, said print head defining a first chamber therein for receiving a working fluid and defining a second chamber therein, comprising:

a. a flexible membrane separating the first chamber and the second chamber;

b. a first transducer in communication with the working fluid in the first chamber for inducing a first pressure wave in the working fluid in the first chamber, so that said membrane flexes into the second chamber; and c. a second transducer in communication with the working fluid the first chamber for inducing a second pressure wave in the working fluid in the first chamber, so that said membrane flexes into the second chamber.

10. A print head for printing an image on a receiver, said print head defining a first chamber therein for receiving a working fluid and defining a second chamber therein, comprising:

a. a flexible membrane separating the first chamber and the second chamber;

b. a first transducer in communication with the working fluid for inducing a first pressure wave in the working fluid flexing said membrane into the second chamber, so that said membrane transmits the first pressure wave into the second chamber; and c. a second transducer in communication with the working fluid for inducing a second pressure wave in the working fluid flexing said membrane into the second chamber, so that said membrane transmits the second pressure wave into the second chamber to damp the first pressure wave transmitted into the second chamber.

11. A method of assembling a thermal ink jet printer for printing an image on a receiver, comprising the steps of:

a. providing a print head defining a chamber therein for receiving a working fluid and defining a second chamber therein;

b. separating the first chamber and the second chamber with a flexible membrane;

c. disposing a first transducer in communication with the working fluid in the first chamber for inducing a first pressure wave in the working fluid in the first chamber; and d. disposing a second transducer in communication with the working fluid in the first chamber for inducing a second pressure wave in the working fluid in the first chamber, so that the membrane flexes into the second chamber.

12. A method of assembling a thermal ink jet printer for printing an image on a receiver, comprising the steps of:

a. providing a print head defining a first chamber therein for receiving a working fluid and defining a second chamber therein;

b. separating the first chamber and the second chamber with a flexible membrane;

c. disposing a first transducer in the first chamber, the first transducer in communication with the working fluid for inducing a first pressure wave in the working fluid capable of flexing the membrane into the second chamber, so that the membrane transmits the first pressure wave into the second chamber; and d. disposing a second transducer in the chamber, the second transducer in communication with the working fluid for inducing a second pressure wave in the working fluid capable of flexing the membrane into the second chamber, so that the membrane transmits the second pressure wave into the second chamber to damp the first pressure wave transmitted into the second chamber.

13. A method of assembling a thermal ink jet printer for printing an image on a receiver, comprising the steps of:

a. providing a print head defining a first chamber and a second chamber therein for receiving a working fluid and an ink body, respectively, the second chamber having an outlet;

b. separating the first chamber and the second chamber with a flexible membrane;

c. disposing a first transducer in the first chamber and in fluid communication with the working fluid for inducing a first pressure wave in the working fluid to thereby flex the membrane into the second chamber, so that the membrane transmits the first pressure wave into the ink body to separate an ink drop from the ink body, the ink drop exiting the outlet to be intercepted by the receiver to print the image on the receiver; and d. disposing a second transducer in the first chamber and in fluid communication with the working fluid for inducing a second pressure wave in the working fluid to thereby flex the membrane into the second chamber, so that the membrane transmits the second pressure wave into the ink body to damp the first pressure wave transmitted into the ink body.

14. A method of assembling a print head for printing an image on a receiver, the print head defining a first chamber therein for receiving a working fluid and defining a second chamber therein, comprising the steps of:

a. separating the first chamber and the second chamber with a flexible membrane;

b. disposing a first transducer in communication with the working fluid in the first chamber for inducing a first pressure wave in the working fluid in the first chamber; and c. disposing a second transducer in communication with the working fluid in the first chamber for inducing a second pressure wave in the working fluid in the first chamber, so that the membrane flexes into the second chamber.

15. A method of assembling a print head for printing an image on a receiver, the print head defining a first chamber therein for receiving a working and defining a second chamber therein, comprising the steps of:

a. separating the first chamber and the second chamber with a flexible membrane;

b. disposing a first transducer in communication with the working fluid for inducing a first pressure wave working fluid flexing the membrane into the second chamber, so that the membrane transmits the first pressure wave into the second chamber; and c. disposing a second transducer in communication with the working fluid for inducing a second pressure wave in the working fluid flexing the membrane into the second chamber, so that the membrane transmits the second pressure wave into the second chamber to damp the first pressure wave transmitted into the second chamber.

16. A thermal ink jet printer, comprising:

a. a print head defining a first chamber and a second chamber therein;

b. a flexible membrane separating the first chamber and the second chamber; and a first transducer and a second transducer disposed in the first chamber, which includes a working fluid, and in fluid communication with the working fluid to flex the membrane into the second chamber having an ink body.

* * * * *

UNITED STATES PATENT AND TRADEMARK OFFICE

CERTIFICATE OF CORRECTION

PATENT NO. : 6,705,716 B2
APPLICATION NO. : 09/975802
DATED : March 16, 2004
INVENTOR(S) : James A. Mott It is certified that error appears in the above-identified patent and that said Letters Patent is hereby corrected as shown below:

Column 4, line 40, delete “tranducers” and insert in lieu thereof --transducers--;

Column 12, line 38 delete “ad” and insert in lieu thereof --and--.

Signed and Sealed this

Fourteenth Day of November, 2006

JON W. DUDAS
*Director of the United States Patent and Trademark Office*